United States Patent [19]

Schulze et al.

[11] Patent Number: 4,943,299

[45] Date of Patent: Jul. 24, 1990

[54] LEVELLING AGENTS FOR DISPERSE DYEING OF POLYESTER: ETHOXYLATE OR PROPOXYLATE OF SUBSTITUTED PHENOL, EMULSIFIER AND CARRIER

[75] Inventors: Hans Schulze, Cologne; Klaus Walz, Leverkusen; Frank Bartkowiak, Cologne; Karlhans Jakobs, Bergisch Gladbach, all of Fed. Rep. of Germany

[73] Assignee: Bayer Aktiengesellschaft, Leverkusen, Fed. Rep. of Germany

[21] Appl. No.: 247,796

[22] Filed: Sep. 22, 1988

[30] Foreign Application Priority Data

Oct. 9, 1987 [DE] Fed. Rep. of Germany ..... 3734159

[51] Int. Cl.[5] ..... D06P 1/65; D06P 3/54

[52] U.S. Cl. ..... 8/610; 8/588; 8/589; 8/609; 8/922; 252/8.6; 252/8.7; 252/8.9

[58] Field of Search ..... 8/620, 610; 252/8.9

[56] References Cited

U.S. PATENT DOCUMENTS 4,516,979 5/1985 Baumann ..... 8/583

4,557,730 12/1985 Bennett et al. ..... 8/442

FOREIGN PATENT DOCUMENTS 2123019 1/1984 United Kingdom .

*Primary Examiner*—A. Lionel Clingman

*Attorney, Agent, or Firm*—Sprung, Horn, Kramer & Woods

[57] ABSTRACT

Levelling agents containing

I. ethers of the general formula

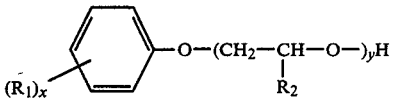

in which $R_1$ denotes alkyl, alkenyl, cycloalkyl, aryl or aralkyl, $R_2$ denotes hydrogen or methyl, x denotes 1, 2 or 3 and y denotes 0 to 7, and II. emulsifiers and, if desired, III. carriers for the dyeing of polyesters are used for the high-temperature dyeing of polyester fibres and polyester-containing materials.

12 Claims, No Drawings

LEVELLING AGENTS FOR DISPERSE DYEING OF POLYESTER: ETHOXYLATE OR PROPOXYLATE OF SUBSTITUTED PHENOL, EMULSIFIER AND CARRIER

The invention relates to levelling agents containing

I. ethers of the general formula

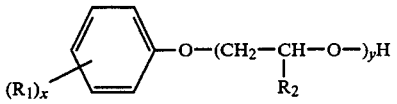

in which $R_1$ denotes alkyl, alkenyl, cycloalkyl, aryl or aralkyl, $R_2$ denotes hydrogen or methyl, x denotes 1, 2 or 3 and y denotes 0 to 7, and II. emulsifiers and, if desired, III. carriers for the dyeing of polyesters and processes for the high-temperature dyeing of polyester fibres and polyester-containing materials in the presence of these levelling agents.

The levelling agents preferably contain

10–90 parts by weight of component I,

3–30 parts by weight of component II and

0–70 parts by weight of component III.

Preferred levelling agents contain

I. 20–50 parts by weight, in particular 20–35 parts by weight, of the ether

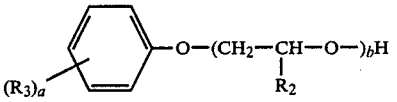

in which $R_3$ denotes $C_1$–$C_6$-alkyl, cyclohexyl, benzyl, phenylethyl or 2-phenylisopropyl, whose rings can be substituted by $C_1$–$C_4$-alkyl, it being possible for the radicals $R_3$ to be identical or different and the sum of the C atoms of $(R_3)_a$ being at least 4, a denotes 1–3, in particular 2 or 3, and b denotes 0–5 and $R_2$ has the abovementioned meaning, II. 5–20 parts by weight of a non-ionic, anionic or amphoteric emulsifier and III. 10–70, in particular 20–70, parts by weight of a carrier.

Preferably, the weight ratio of I:II:III is 1–2:1:2–5.

Components I are in particular those having the meanings $R_2$=hydrogen or methyl, $R_3$=tert.-amyl or phenylethyl, a=2 or 3 and b=3–5.

Examples of component I are adducts of up to 7, in particular up to 5, mol of ethylene oxide, which can be replaced by propylene oxide to up to 20%, with cyclohexylphenol, mono- and di-tert.-butylphenol, mono- and di-tert.-amylphenol, mono-, di- and triphenylethylphenol, mono-, di- and triphenylisopropylphenol, mono-, di-, and tritolylphenol, benzylphenylethylphenol and methylphenylethylphenol.

Suitable components II are in particular nonionic and anionic emulsifiers. They serve for emulsifying components I and III in water. Their amount and type are selected in such a way that the levelling agents according to the invention are emulsifiable in the aqueous dyebath. They can be determined by preliminary tests.

Examples of component II are adducts of 8 and more mol of ethylene oxide and, if desired, propylene oxide with vegetable oils such as castor oil or soya bean oil, with $C_{18}$–$C_{22}$-alkanols, $C_8$–$C_{12}$-alkylphenols or phenyl-$C_1$–$C_3$-alkylphenols and also alkali metal, alkaline earth metal and ammonium salts of aliphatic and aromatic sulphonic acids having a total of at least 10 C atoms such as dodecylbenzenesulphonic acid, diisobutylnaphthalenesulphonic acid, α-sulphofatty acids or ricinoleylmethyltauride. The emulsifiers can be used individually or in a mixture. Preference is given to mixtures consisting of the non-ionic and anionic emulsifiers mentioned.

As component III of the composition according to the invention, active substances which are called carriers and facilitate the penetration of the dyestuffs into the fibre can be added to optimize the dyeing properties. Compounds of this type and their mode of action are described, for example, by K. Jåkobs in Textilpraxis International 1973, 9, p. 521–524.

These substances can be added both individually and also in a mixture. A satisfactory result in terms of dyeing can, in many cases, also be obtained without the addition of carrier-active components.

Examples of component III are aromatic carboxylic esters, carbonic esters, ethers and ketones such as esters of benzoic acid, salicylic acid and terephthalic acid, diphenyl carbonate, phenoxyethanol and acetophenone, aromatic hydrocarbons, halo-hydrocarbons and phenols such as biphenyl, tetralin, mono-, di- and trichlorobenzene and mono-, di- and trichlorotoluene and phenylphenol and N-alkylphthalimides. A particularly preferred component III comprises N-alkylphthalimides. Preferred alkyl groups are $C_3$–$C_6$-alkyl groups.

The disperse dyestuffs used for the dyeing process according to the invention are the disperse dyestuffs which are usually employed for the dyeing of polyester and are described, for example, in "Colour Index", Vol. 2. p. 2483–2741, 3rd edition (1971).

The process according to the invention is carried out under high-temperature conditions by the process customary for the dyeing with disperse dyestuffs. The optimum concentration of the formulations according to the invention can easily be determined by preliminary tests. It is 1.0 to 4.5 g per litre of dyeing liquor.

The addition of the levelling agents according to the invention to the dyebaths gives emulsions, which are distinguished at the same time by an excellent levelling action and a very good dispersing effect on the dyestuffs used and little foam formation during the dyeing process.

The dyeing is carried out in such a manner that the polyester materials are treated with the dyeing liquor which contains the levelling agent formulation and the dyestuffs in a known manner.

Here the levelling agent formulations according to the invention, the disperse dyestuffs and, if necessary, agents for controlling the pH, for example sodium dihydrogen phosphate as a buffer and acetic acid, are introduced into a warm dyebath of 50° to 70° C. and brought to the dyeing temperature of 90° to 140° C., in particular 120 to 140° C.

The dyeing time is about 1 hour.

In the hitherto customary dyeing processes, dispersing agents, for example sulphonated naphthalene/formaldehyde condensates, had to be added additionally to the dyeing liquors.

EXAMPLES

Levelling agent formulations: (given in % by weight)

(1) 20% of tri(phenylethyl)phenol
60% of N-butylphthalimide
8% of stearyl hexaethylene glycol ether
9% of castor oil, reacted with 30 mol of ethylene oxide
3% of calcium dodecylbenzenesulphonate (2) 20% of di(phenylethyl)phenol triethylene glycol ether
60% of N-butylphthalimide
8% of stearyl hexaethylene glycol ether
9% of castor oil, reacted with 30 mol of ethylene oxide
3% of calcium dodecylbenzenesulphonate (3) 20% of di(phenylethyl)phenol tetraethylene glycol ether
60% of N-butylphthalimide
8% of oleyl tetraethylene glycol ether
9% of castor oil, reacted with 30 mol of ethylene oxide
3% of calcium dodecylbenzenesulphonate (4) 20% of tri(phenylethyl)phenol tripropylene glycol ether
60% of N-butylphthalimide
8% of hexaethylene glycol oleate
9% of castor oil, reacted with 30 mol of ethylene oxide
3% of calcium dodecylbenzenesulphonate (5) 30% of tri(phenylethyl)phenol tripropylene glycol ether
55% of methyl o-cresotinate
11% of castor oil, reacted with 30 mol of ethylene oxide
4% of calcium dodecylbenzenesulphonate (6) 30% of tri(phenylethyl)phenol tetrapropylene glycol ether
53% of 1,2,4-trichlorobenzene
7% of stearyl hexaethylene glycol ether
5% of dodecylbenzenesulphonic acid monoethanolamine salt
5% of the adduct of 16 mol of ethylene oxide with 1 mol of the addition product of 2.7 mol of p-vinyl toluene with 1 mol of phenol (7) 20% of 2,4-bis(1,1-dimethylpropyl)phenol tetraethylene glycol ether
60% of N-alkylphthalimides (alkyl = propyl, butyl, pentyl)
8% of stearyl hexaethylene glycol ether
9% of castor oil, reacted with 30 mol of ethylene oxide
3% of calcium dodecylbenzenesulphonate (8) 30% of 2,4-bis(1,1-dimethylpropyl)phenol pentaethylene glycol ether
14% of N-butylphthalimide
16% of methyl o-cresotinate
8% of dimethyl phthalate
8% of stearyl hexaethylene glycol ether
8% of N-butyl benzoate
6% of diphenyl carbonate
5% of dodecylbenzenesulphonic acid monoethanolamine salt
5% of the adduct of 16 mol of ethylene oxide with 1 mol of the addition product of 2.7 mol of p-vinyl toluene with 1 mol of phenol

Dyeing examples:

1. A piece goods material consisting in the warp and the weft of a polyester staple fibre yarn is introduced in a jet dyeing machine in a liquor ratio of 15:1 into a dyebath heated to 50°-60° C., which contains per liter 0.2 g of dyestuff of the formula

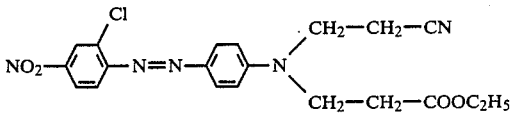

and 1.5 of levelling agent formulation 2. The pH of the bath is adjusted with 2 g/l of sodium dihydrogen phosphate and acetic acid to 4.5-5. The dyeing liquor thus charged is heated to 130° C. in 90 minutes and kept at this temperature for 30 minutes. After cooling and washing, a uniformly dyed, dark red colour is obtained. It should be emphasized that during the dyeing, cooling and washing no foam whatsoever could be detected in the jet dyeing machine, despite intensive agitation of the liquor.

A similarly good result is obtained by using the levelling agent formulations 1 and 3-8 instead of the levelling agent formulation 2.

2. Packages of textured polyester filament yarn are introduced in a liquor ratio of 10:1 into a dyebath heated to 60°-70° C. and containing per litre 0.25 g of the dyestuff of the formula and 2 g of the

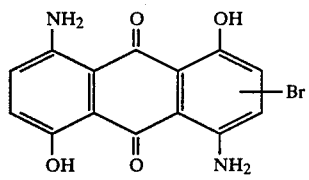

levelling agent formulation 1. The pH of the bath is adjusted with 1 g/l of sodium dihydrogen phosphate and acetic acid to 4.5-5. The dyeing liquor thus charged is heated to 130° C. in 90 minutes and kept at this temperature for 30 minutes. After cooling and washing, a uniformly dyed, dark red colour is obtained. It should be emphasized that during the dyeing, cooling and washing no foam whatsoever could be detected in the jet dyeing machine, despite intensive agitation of the liquor.

A similarly good result is obtained by using the levelling agent formulations 2-8 instead of the levelling agent formulation 1.

We claim:

1. A levelling agent consisting essentially of (I) a compound of the formula

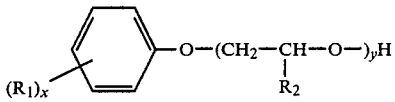

in which $R_1$ denotes $C_1$-$C_3$-alkyl, cyclohexyl, benzyl, phenyethyl or 2-phenylisopropyl, the rings of which are unsubstituted or substituted by $C_1$-$C_4$-alkyl, $R_2$ denotes hydrogen or methyl, x denotes 1, 2 or 3 and y denotes 0 to 5, and (II) an emulsifier, with or without (III) a carrier for the dyeing of polyesters, wherein the emulsifier II comprises (a) 8 or more moles of ethylene oxide or propylene oxide reacted with (b) castor oil, soybean oil, a $C_{18}$-$C_{22}$-alkanol, a $C_8$–$C_{12}$-alkylphenol or a phenyl-$C_1$–$C_3$-alkylphenol, or alternatively the emulsifier II comprises an alkali metal, an alkaline earth metal or an ammonium salt of an aliphatic sulfonic acid having a total of at least 10 carbon atoms or of an aromatic sulfonic acid having a total of at least 10 carbon atoms, or mixtures thereof, wherein the emulsifier II serves to emulsify the compound I and optionally to emulsify the carrier III in water.

2. A levelling agent according to claim 1, comprising
10–90 parts by weight of component I,
3–30 parts by weight of component II and
0–70 parts by weight of component III.

3. A levelling agent according to claim 1 comprising
I. 20–50 parts by weight, of a compound of the formula

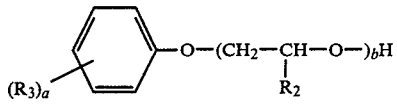

in which
$R_3$ denotes $C_1$–$C_3$-alkyl, cyclohexyl, benzyl, phenylethyl or 2-phenylisopropyl, the rings of which being unsubstituted or substituted by $C_1$–$C_4$-alkyl, the radicals $R_3$ being identical or different and the sum of the C atoms of $(R_3)a$ being at least 4,
a denotes 1–3,
b denotes 0–5 and
$R_2$ being hydrogen or methyl,
II. 5–20 parts by weight of said emulsifier and
III. 10–70 parts by weight of a carrier.

4. A levelling agent according to claim 3, containing as component I compounds
$R_2$=hydrogen or methyl,
$R_3$=phenylethyl,
a=2 or 3 and
b=3–5.

5. A leveling agent according to claim 1, containing as component III aromatic carboxylic esters, carbonic esters, ethers, ketones, hydrocarbons, halohydrocarbons, phenols or N-alkylphthalimides.

6. A leveling agent according to claim 7, containing as component III N-alkylphthalimides.

7. A leveling agent according to claim 1, containing the components I, II and III in a weight ratio of 1–2:1-:2–5.

8. A leveling agent according to claim 3, wherein a is 2 or 3.

9. A process for the dyeing of polyester fibers and polyester-containing materials comprising conducting dyeing in an aqueous dye bath by contacting the fibers or materials with a dye at temperatures from 90°–140° C. and employing a leveling agent to improve the levelling properties of the dye, said leveling agent consisting essentially of
(I) a compound of the formula

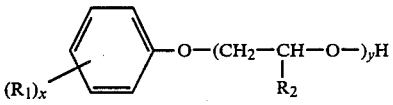

in which
$R_1$ denotes $C_1$–$C_6$-alkyl, cyclohexyl, benzyl, phenyethyl or 2-phenylisopropyl, the rings of which are unsubstituted or substituted by $C_1$–$C_4$-alkyl,
$R_2$ denotes hydrogen or methyl,
x denotes 1, 2 or 3 and
y denotes 0 to 5, and
(II) an emulsifier, with or without (III) a carrier for the dyeing of polyesters,
wherein the emulsifier II comprises (a) 8 or more moles of ethylene oxide or propylene oxide reacted with (b) castor oil, soybean oil, a $C_{18}$–$C_{22}$-alkanol, a $C_8$–$C_{12}$-alkylphenol or a phenyl-$C_1$–$C_3$-alkylphenol, or alternatively the emulsifier II comprises an alkali metal, an alkaline earth metal or an ammonium salt of an aliphatic sulfonic acid having a total of at least 10 carbon atoms or of an aromatic sulfonic acid having a total of at least 10 carbon atoms, or mixtures thereof, wherein the emulsifier II serves to emulsify the compound I and optionally to emulsify the carrier III in water.

10. A process according to claim 9, wherein the temperature is 120° C. to 140° C.

11. A process according to claim 9, wherein the concentration of the levelling agent is 1.0 to 4.5 g per liter of dyeing liquor.

12. A composition for improving the levelling properties of a dye comprising a leveling agent according to claim 1 and water.

* * * * *

UNITED STATES PATENT AND TRADEMARK OFFICE

CERTIFICATE OF CORRECTION

PATENT NO. : 4,943,299

DATED : July 24, 1990

INVENTOR(S) : Schulze et al.

It is certified that error appears in the above-identified patent and that said Letters Patent is hereby corrected as shown below:

Col. 5, claim 3 Delete " $(R_3)a$ " and substitute -- $(R_3)_a$--
line 30

Signed and Sealed this

Fifth Day of May, 1992

*Attest:*

DOUGLAS B. COMER

*Attesting Officer*

*Acting Commissioner of Patents and Trademarks*